US006857887B1

(12) United States Patent
Belson et al.

(10) Patent No.: US 6,857,887 B1
(45) Date of Patent: Feb. 22, 2005

(54) CURRENT LIMIT ENGAGEMENT APPARATUS

(75) Inventors: Steve Belson, Plano, TX (US); Walter G. Lorber, Plano, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/697,680

(22) Filed: Oct. 29, 2003

(51) Int. Cl.[7] ..... H01R 13/53
(52) U.S. Cl. ..... 439/181
(58) Field of Search ..... 439/181, 620, 439/924.1, 886, 668, 669, 840

(56) References Cited

U.S. PATENT DOCUMENTS 4,747,783 A * 5/1988 Bellamy et al. ..... 439/59
4,954,794 A * 9/1990 Nieman et al. ..... 333/182
6,102,742 A * 8/2000 Daly ..... 439/620
6,296,499 B1 * 10/2001 Hermann et al. ..... 439/181
6,623,288 B2 * 9/2003 Sakiyama et al. ..... 439/181
2003/0187445 A1 * 10/2003 Keith et al. ..... 606/72
2003/0194893 A1 * 10/2003 Ota et al. ..... 439/181

* cited by examiner

*Primary Examiner*—Tho D. Ta
(74) *Attorney, Agent, or Firm*—Leslie P. Gehman

(57) ABSTRACT

An electrical connector is constructed with at least one pin configured to provide different resistance values as the pin is engaged with a socket. When the connector is fully engaged with the socket the resistance of the connector is at a zero or minimal value. When the pin first contacts the socket, the pin includes a high series resistance minimizing the sudden inrush of current to an electrical device, and minimizing any arcing between the pin and the socket. As the pin engages the socket this series resistance decreases allowing the electronic device to utilize its full designed current with only minimal contact resistance between the pin and the socket.

3 Claims, 8 Drawing Sheets

CURRENT LIMIT ENGAGEMENT APPARATUS

FIELD OF THE INVENTION

This invention is related to the field of electrical connectors, and more specifically to the field of electrical connectors designed to reduce current inrush peaks during plug in.

BACKGROUND OF THE INVENTION

When an electronic device is plugged in or turned on in an AC or DC electrical circuit, the electric plug's male and female connections come together and high current immediately begins to flow through the pins. Once any contact (and sometimes before contact if an arc occurs) is made on the pins, fill normal operating current flows through the device. Thus, in many electronic devices the pins are designed so that any part of the pins or socket can immediately handle the full normal operating current. If due to space (or other) constraints, the pins are not designed for an individual pin to handle the full normal operating current, there is a high probability of damage to the pins or the socket from arcing, overheating, or stress from the instant flow of full current. It is also possible that there will exist a safety hazard since many connectors designed to handle high currents have exposed metal parts allowing people to receive electric shocks or burns.

Other electronic devices include capacitors requiring initial charging once power is connected to the device. Once power is connected, the capacitors draw high current until they reach full charge. Capacitor lifespan and reliability can be improved by limiting the charging current to the capacitor. Some designs include resistors in series with the capacitors to act as current limiters, however, it is only necessary to limit current to the capacitor during initial charge up, and once fully charged, the resistor is no longer necessary, and in fact, may cause continuous power dissipation during normal operation of the device. Other designs use a relay or transistor to limit the initial charge up current, however this solution still leaves a small series resistance, and requires extra components in the design of the device, thus slightly reducing the overall reliability of the device. Still other designs use a positive temperature coefficient (PTC) device that starts out with a high resistance while cold and decreases in resistance as it heats up. However, this solution still continually dissipates enough power to keep the PTC device hot, and adds an extra component to the design of the electronic device.

SUMMARY OF THE INVENTION

An electrical connector is constructed with at least one pin configured to provide different resistance values as the pin is engaged with a socket. When the connector is fully engaged with the socket the resistance of the connector is at a zero or minimal value. When the pin first contacts the socket, the pin includes a high series resistance minimizing the sudden inrush of current to an electrical device, and minimizing any arcing between the pin and the socket. As the pin engages the socket this series resistance decreases allowing the electronic device to utilize its full designed current with only minimal contact resistance between the pin and the socket.

Other aspects and advantages of the present invention will become apparent from the following detailed description, taken in conjunction with the accompanying drawings, illustrating by way of example the principles of the invention.

DETAILED DESCRIPTION

Figure 1:
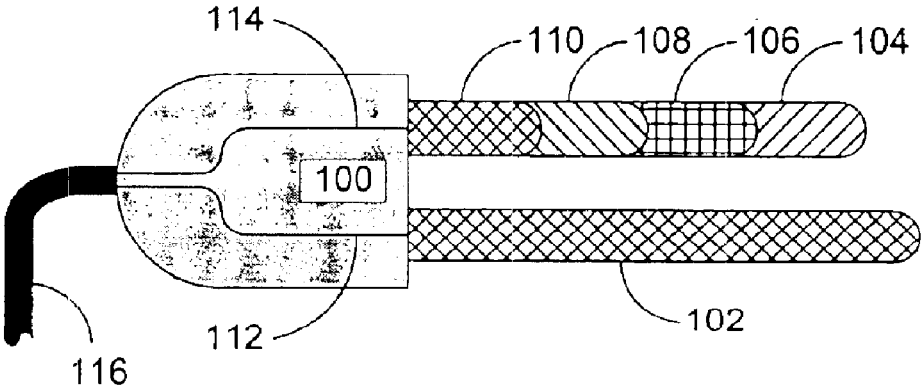
FIG. 1 is a side view of an example embodiment of a current limit engagement apparatus according to the present invention.

FIG. 1 is a side view of an example embodiment of a current limit engagement apparatus according to the present invention. In this example embodiment of the present invention a two-pronged power plug is shown including a plug body 100, a ground conductor 112, a power conductor 114, a cable 116 for connecting the plug to an electric device, a ground pin 102, and a power pin including a current limiting apparatus. Note that in this example embodiment of the present invention, the ground pin 102 is longer than the power pin. This allows the ground pin to make first connection with a mating socket before the power pin starts to make a connection. In this example embodiment of the present invention the power pin includes a first segment 104, with a high series resistive value to limit the initial inrush of current to the electric device, a second segment 106, with a lower resistive value than the first segment 104, a third segment 108, with a lower resistive value than the second segment 106, and a fourth segment 110, with the lowest resistive value that is present during normal operation of the electric device. This example embodiment of the present invention is designed to mate with the socket from FIG. 2. However, those of skill in the art will recognize that there are many possible configurations of pins and sockets available to the designer within the scope of the present invention. For example, any number of pins may be used in the plug in any combination of normal low resistance pins and current limit engagement pins. Also the pin sizes and shapes may be varied as needed for a given design all within the scope of the present invention.

Those of skill in the art will recognize that this example embodiment of the present invention is but one of many possible embodiments within the scope of the present invention. While the terms "power pin" and "ground pin" are used in this particular embodiment of the present invention, other embodiments may use other terms to refer to the pin including the current limiting apparatus, and the normal pin without any current limiting apparatus.

Figure 2:
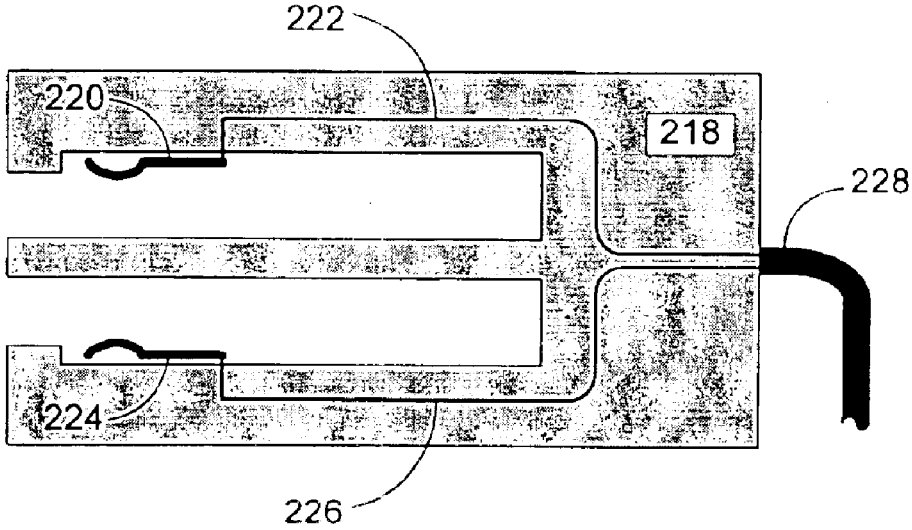
FIG. 2 (Prior Art)
FIG. 2 is a cross-sectional view of a prior art connector configured to accept a current limit engagement apparatus according to the present invention.

FIG. 2 is a cross-sectional view of a prior art connector configured to accept a current limit engagement apparatus according to the present invention. The socket shown in FIG. 2 is simply a standard electric socket configured to accept the plug shown in FIG. 1. This example socket includes a socket body 218, a first contact 220 connected to a cable 228 by a first conductor 222, and a second contact 224 connected to the cable 228 by a second conductor 226.

Figure 3A:
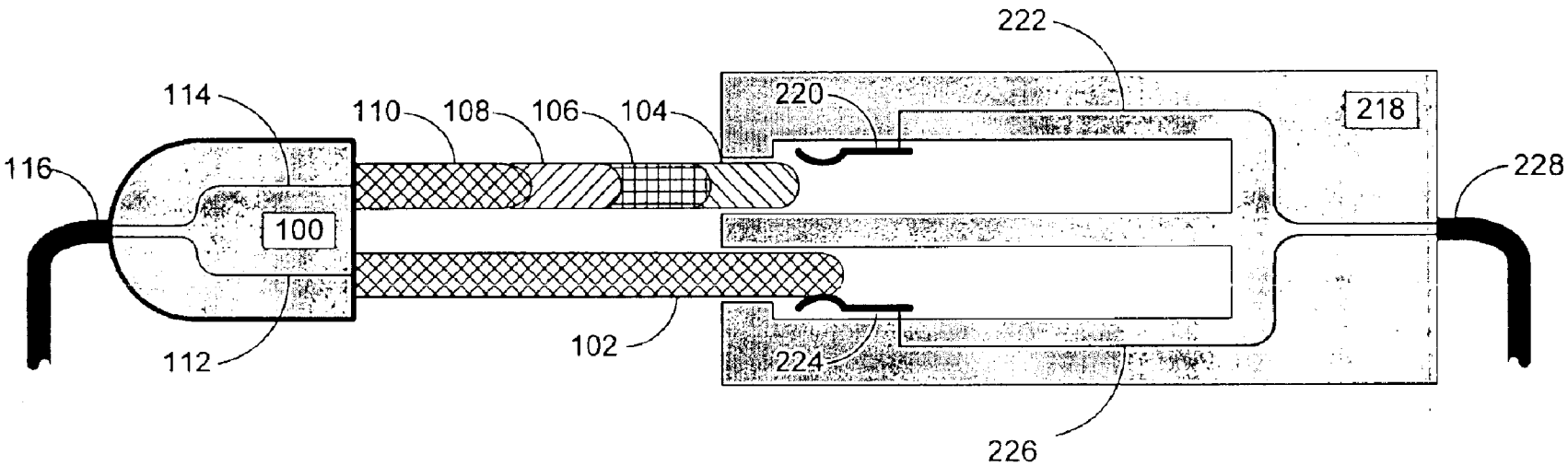
FIG. 3A is a cross-sectional view of an example embodiment of a current limit engagement apparatus as it is inserted into a prior art connector configured to accept the current limit engagement apparatus according to the present invention.

FIG. 3A is a cross-sectional view of an example embodiment of a current limit engagement apparatus as it is inserted into a prior art connector configured to accept the current limit engagement apparatus according to the present invention. In this example embodiment of the present invention the electrical plug of FIG. 1 is shown as it is inserted into the socket of FIG. 2. FIG. 3A shows the plug from FIG. 1 at the point during insertion where the ground pin 102 has just made contact with the second contact 224 completing the contact between the two grounds.

Figure 3B:
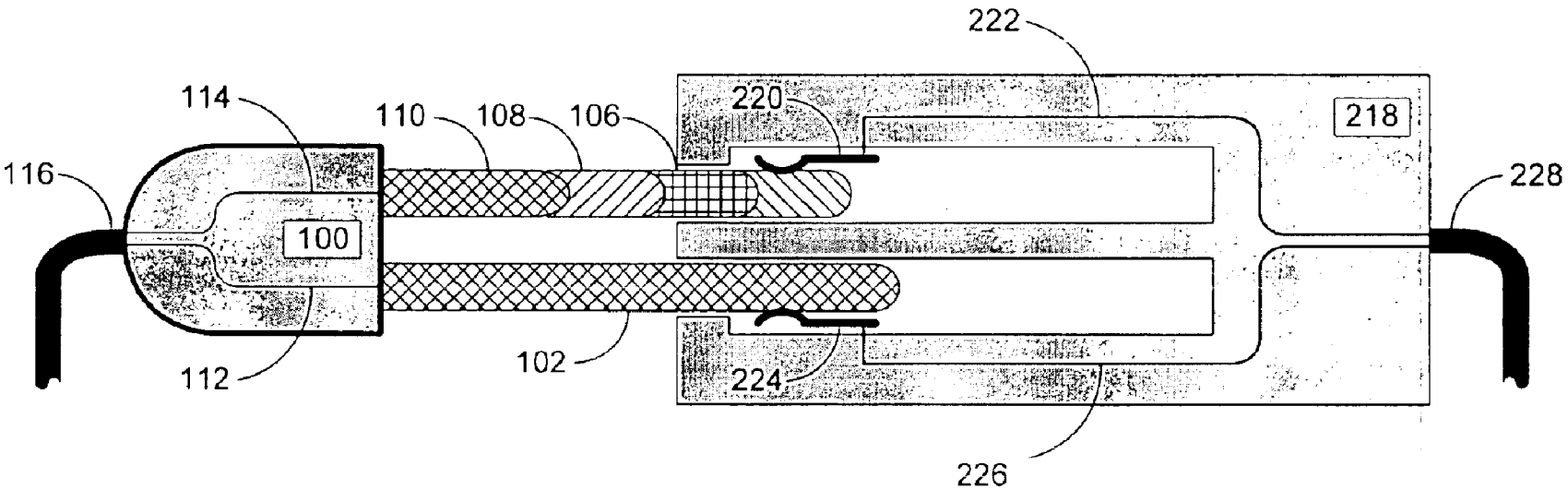
FIG. 3B is a cross-sectional view of an example embodiment of a current limit engagement apparatus as it is inserted into a prior art connector configured to accept the current limit engagement apparatus according to the present invention.

FIG. 3B is a cross-sectional view of an example embodiment of a current limit engagement apparatus as it is inserted into a prior art connector configured to accept the current limit engagement apparatus according to the present invention. FIG. 3B is identical to FIG. 3A, however the plug has been inserted further into the socket. In this figure the first segment 104 has now made contact with the first contact 220 in the socket. At this point the ground pin 102 is fully contacted with low resistance and the power pin is electrically connected to the first conductor 222 and whatever lies at the end of the socket cable 228 however there is a high series resistance between the first segment 104 and the power conductor 114. This high series resistance limits the inrush of current to whatever electric device is at the end of the plug cable 116.

Figure 3C:
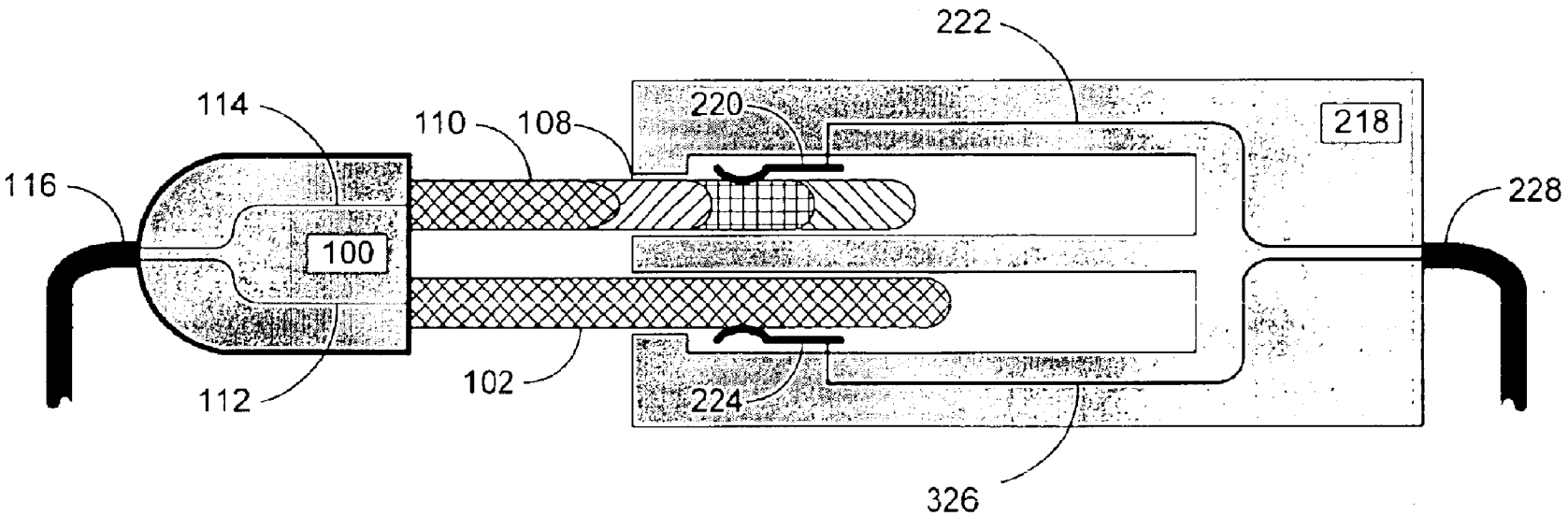
FIG. 3C is a cross-sectional view of an example embodiment of a current limit engagement apparatus as it is inserted into a prior art connector configured to accept the current limit engagement apparatus according to the present invention.

FIG. 3C is a cross-sectional view of an example embodiment of a current limit engagement apparatus as it is inserted into a prior art connector configured to accept the current limit engagement apparatus according to the present invention. FIG. 3C is identical to FIG. 3B, however the plug has been inserted further into the socket. In this figure the second segment 106 has now made contact with the first contact 220 in the socket. At this point the ground pin 102 is fully contacted with low resistance and the power pin is electrically connected to the first conductor 222 and whatever lies at the end of the socket cable 228 however there is still a significant series resistance between the second segment 106 and the power conductor 114. This series resistance still acts to limit the inrush of current, but now includes a lower series resistance allowing more current flow into the electric device.

Figure 3D:
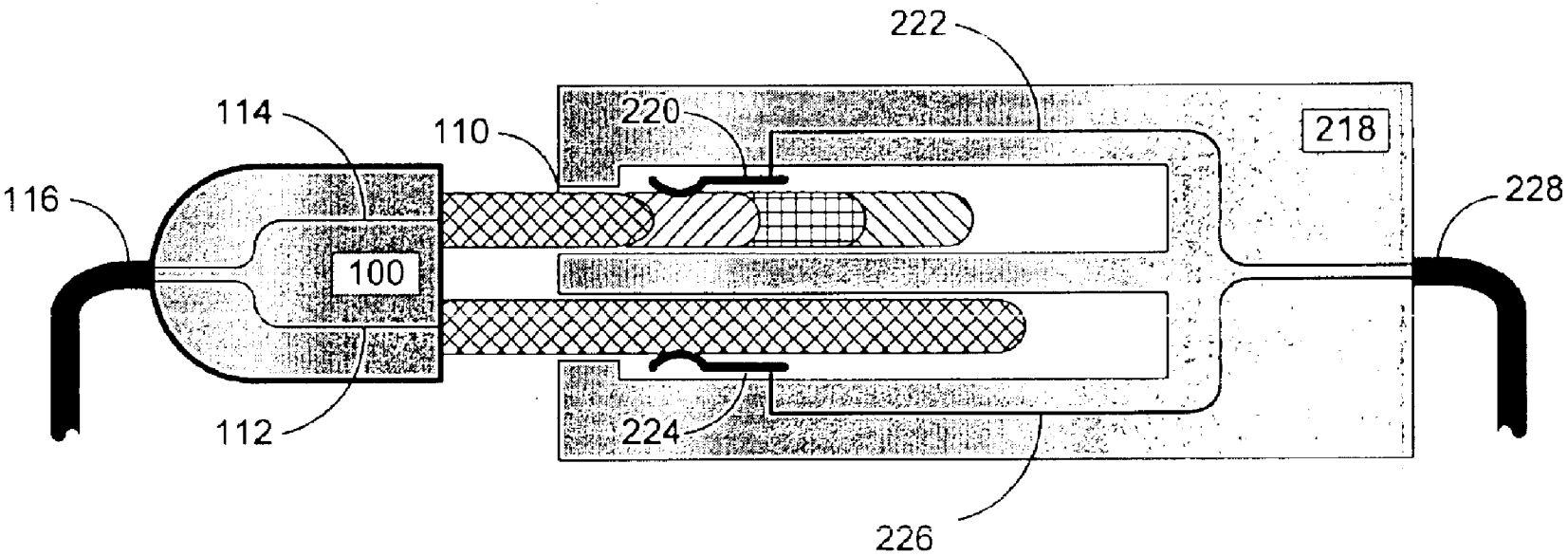
FIG. 3D is a cross-sectional view of an example embodiment of a current limit engagement apparatus as it is inserted into a prior art connector configured to accept the current limit engagement apparatus according to the present invention.

FIG. 3D is a cross-sectional view of an example embodiment of a current limit engagement apparatus as it is inserted into a prior art connector configured to accept the current limit engagement apparatus according to the present invention. FIG. 3D is identical to FIG. 3C, however the plug has been inserted further into the socket. In this figure the third segment 108 has now made contact with the first contact 220 in the socket. At this point the ground pin 102 is fully contacted with low resistance and the power pin is electrically connected to the first conductor 222 and whatever lies at the end of the socket cable 228 however there is still a small series resistance between the third segment 108 and the power conductor 114.

Figure 3E:
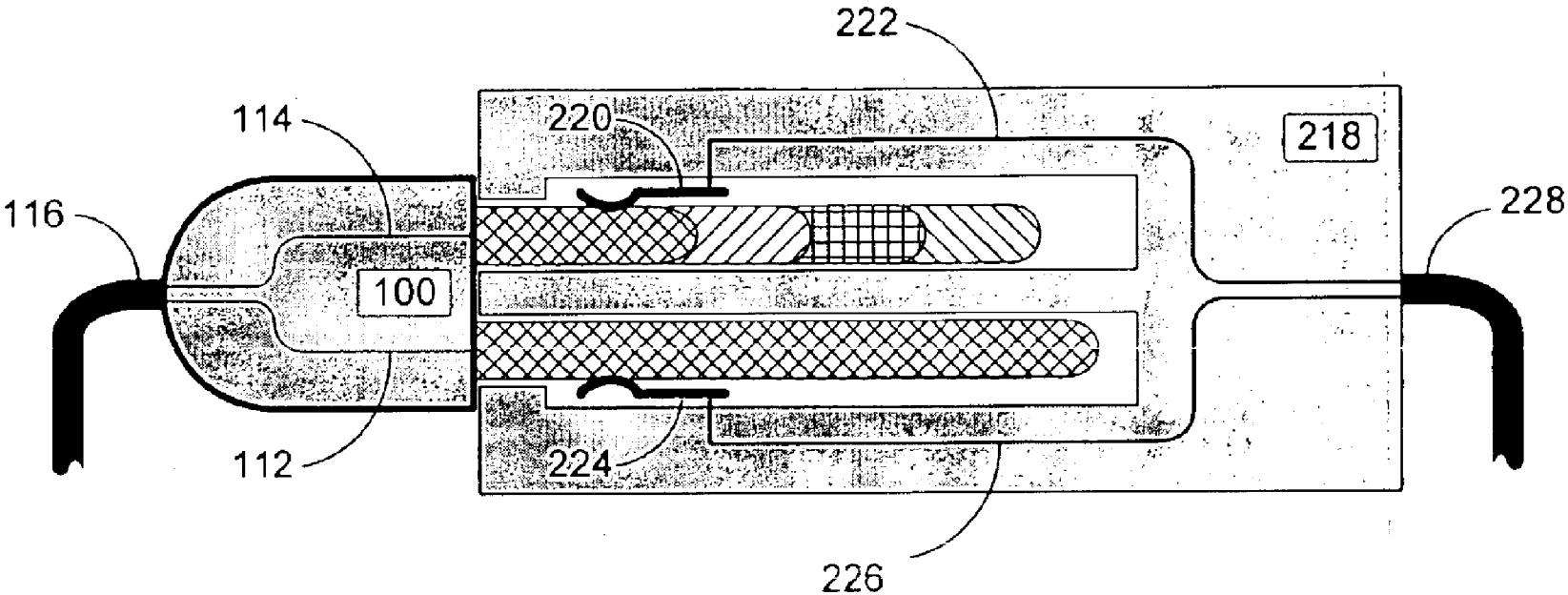
FIG. 3E is a cross-sectional view of an example embodiment of a current limit engagement apparatus as it is inserted into a prior art connector configured to accept the current limit engagement apparatus according to the present invention.

FIG. 3E is a cross-sectional view of an example embodiment of a current limit engagement apparatus as it is inserted into a prior art connector configured to accept the current limit engagement apparatus according to the present invention. FIG. 3E is identical to FIG. 3D, however the plug has been inserted fully into the socket. In this figure the fourth segment 110 has now made contact with the first contact 220 in the socket. At this point the ground pin 102 is fully contacted with low resistance and the power pin is electrically connected to the first conductor 222 and whatever lies at the end of the socket cable 228 with only a small contact resistance between the fourth segment 110 and the power conductor 114. At this point the plug and socket are fully engaged and act as a normal low-resistance connection between the devices at the ends of the two cables 116 and 228.

Figure 4:
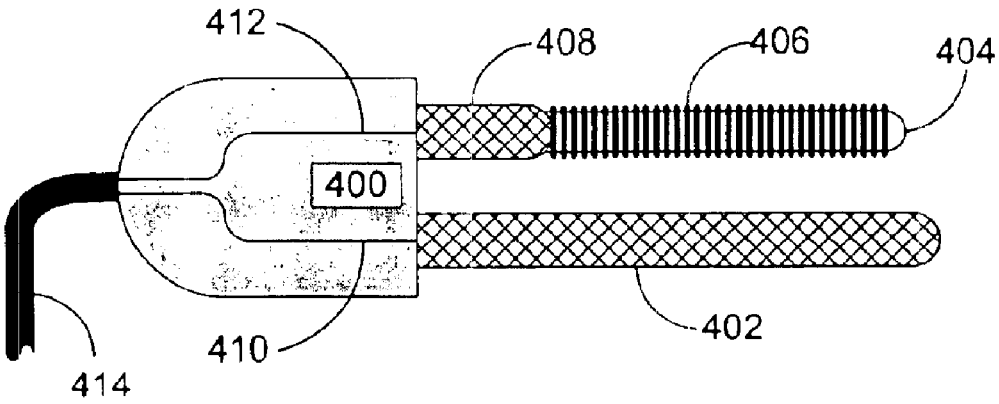
FIG. 4 is a side view of an example embodiment of a current limit engagement apparatus according to the present invention.

FIG. 4 is a side view of an example embodiment of a current limit engagement apparatus according to the present invention. In this example embodiment of the present invention an electrical plug is designed including a plug body 400, a ground pin 402, a power pin 404, a ground conductor 410, a power conductor 412, and a cable 414 connecting the plug to an electrical device. In this example embodiment the outer portion of the power pin 404 is non-conductive and wrapped by a resistive wire 406 similar to those used in sliding potentiometers. The inner portion 408 of the power pin is equivalent to the fourth segment 110 of the plug from FIG. 1 and provides a low resistance normal connection to a socket. This example embodiment of the present invention is designed to mate with the socket from FIG. 2. However, those of skill in the art will recognize that there are many possible configurations of pins and sockets available to the designer within the scope of the present invention. For example, any number of pins may be used in the plug in any combination of normal low resistance pins and current limit engagement pins. Also the pin sizes and shapes may be varied as needed for a given design all within the scope of the present invention.

Figure 5:
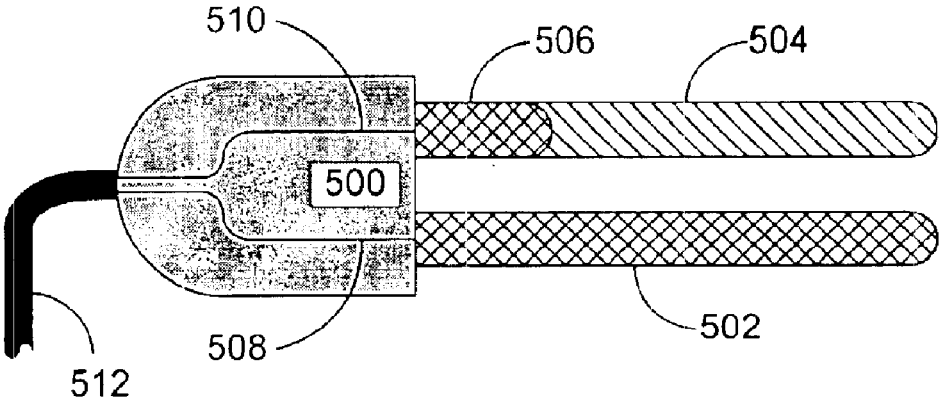
FIG. 5 is a side view of an example embodiment of a current limit engagement apparatus according to the present invention.

FIG. 5 is a side view of an example embodiment of a current limit engagement apparatus according to the present invention. In this example embodiment of the present invention a plug is designed including a plug body 500, a ground pin 502, a power pin 504, a ground conductor 508, a power conductor 510, and a cable 512 connecting the plug to an electrical device. In this example embodiment the outer portion of the power pin 504 is made of a resistive material. On initial contact with a socket, the current flowing through the power pin 504 must travel the entire length of the resistive material resulting in a large series resistance. As the pin is engaged further into the socket, the current needs to travel through less and less of the resistive material until the final inner portion 506 of the power pin 504 is reached. The inner portion 506 of the power pin is equivalent to the fourth segment 110 of the plug from FIG. 1 and provides a low resistance normal connection to a socket. This example embodiment of the present invention is designed to mate with the socket from FIG. 2. However, those of skill in the art will recognize that there are many possible configurations of pins and sockets available to the designer within the scope of the present invention. For example, any number of pins may be used in the plug in any combination of normal low resistance pins and current limit engagement pins. Also the pin sizes and shapes may be varied as needed for a given design all within the scope of the present invention.

Figure 6:
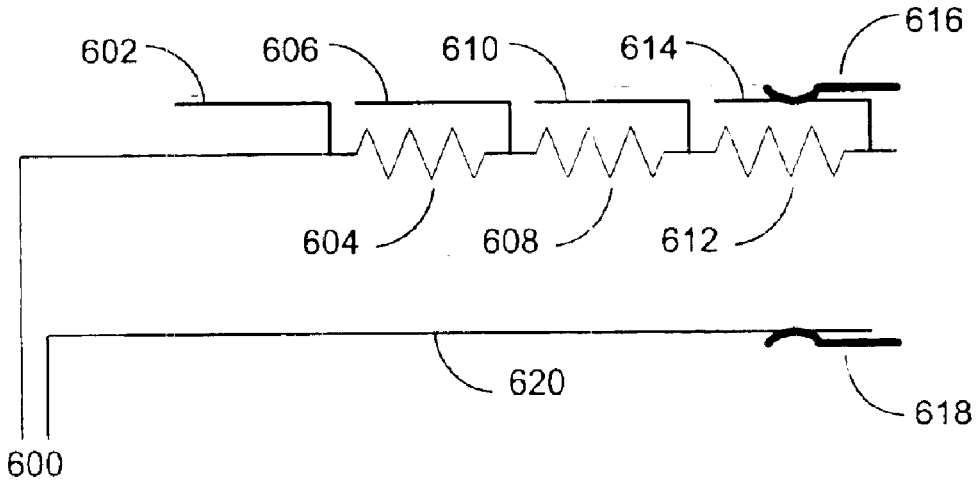
FIG. 6 is a schematic representation of an example embodiment of a current limit engagement apparatus according to the present invention similar to that shown in FIG. 1.

FIG. 6 is a schematic representation of an example embodiment of a current limit engagement apparatus according to the present invention similar to that shown in FIG. 1. In this example embodiment of the present invention a power pin including four segments is shown being inserted into a socket including a ground contact 618 and a power contact 616. At the point shown in this schematic the plug is inserted into the socket such that the first segment 614 of the power pin is in contact with the power contact 616. The power pin also includes a second segment 610, a third segment 606, and a fourth segment 602. The first segment 614 includes a first resistor 612. The second segment 610 includes a second resistor 608. The third segment 606 includes a third resistor 604 and the fourth segment 602 does not have a resistor. The three resistors are connected in series such that when the first segment 614 of the power pin is in contact with the power contact 616, the current must flow through all three resistors. When the second segment 610 of the power pin is in contact with the power contact 616, the current flows through the second and third resistors. When the third segment 606 of the power pin is in contact with the power contact 616, the current flows through the third resistor. Finally, when the fourth segment 602 of the power pin is in contact with the power contact 616, the current does not flow through any of the resistors. Throughout the insertion of the plug into the socket the ground pin 620 is in contact with the ground contact 618 and the plug cable 600 is connected to an electric device.

Figure 7:
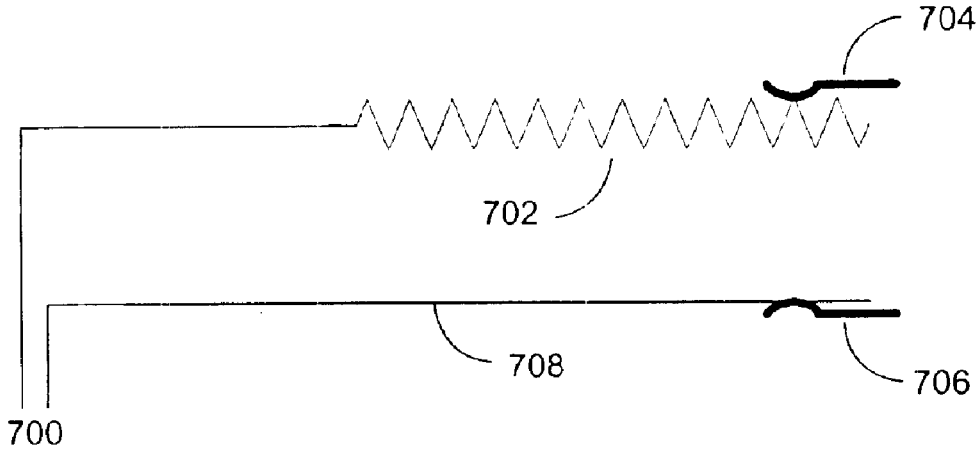
FIG. 7 is a schematic representation of an example embodiment of a current limit engagement apparatus according to the present invention similar to that shown in FIGS. 4 and 5.

FIG. 7 is a schematic representation of an example embodiment of a current limit engagement apparatus according to the present invention similar to that shown in FIGS. 4 and 5. In this example embodiment of the present invention a plug including a power pin and a ground pin 708 is configured to connect to an electric device through a cable 700. The power pin includes a variable resistor 702 such that as the plug is inserted into a socket the series resistance in the power pin is reduced from an initial large value to a very low value when the plug is fully engaged with the socket. The ground pin 708 is in contact with the ground contact 706 throughout the entire engagement of the plug with the socket. The power pin is contacted by the power contact 704 within the socket.

The foregoing description of the present invention has been presented for purposes of illustration and description. It is not intended to be exhaustive or to limit the invention to the precise form disclosed, and other modifications and variations may be possible in light of the above teachings. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A device comprising:

at least one pin without a resistive segment; and a current limiting pin configured for insertion into a socket including:

a resistive segment on a first end of said current limiting pin; and a low resistance segment on a second end of said pin electrically and physically coupled with said resistive segment, and electrically coupled with an electric device;

wherein said current limiting pin is configured to engage with said socket including a contact such that upon insertion into said socket said resistive segment makes electrical contact with said contact before said low resistance segment makes contact with said contact.

2. The device recited in claim 1, wherein said at least one pin without a resistive segment is longer than said current limiting pin.

3. The device recited in claim 2, wherein said at least one pin without a resistive segment is a ground pin.

* * * * *